United States Patent [19]

Grady et al.

[11] Patent Number: 4,523,601

[45] Date of Patent: Jun. 18, 1985

[54] DOUBLE ACTION UMBRELLA

[75] Inventors: Clyde C. Grady, Lonoke County, Ark.; Clyde C. Grady, II, Baytown, Tex.

[73] Assignee: Christianson Manufacturing Corporation, Baytown, Tex.

[21] Appl. No.: 475,770

[22] Filed: May 8, 1983

[51] Int. Cl.[3] ..... A45B 25/14; A45B 25/16

[52] U.S. Cl. ..... 135/22; 135/20 B; 135/20 M; 135/24

[58] Field of Search ..... 135/22, 20 B, 24, 20 R; 124/61

[56] References Cited

U.S. PATENT DOCUMENTS 4,169,456 10/1979 Van House ..... 124/61

4,421,133 12/1983 Huang ..... 135/22

*Primary Examiner*—Robert A. Hafer

*Assistant Examiner*—D. Neal Muir

[57] ABSTRACT

A device is disclosed whereby both the opening and the closing of a device commonly known as an umbrella is accomplished automatically.

2 Claims, 6 Drawing Figures

DOUBLE ACTION UMBRELLA

BACKGROUND OF THE INVENTION

It is known in the art to construct umbrellas which open automatically with the manual release of a catch wherein the compression of a spring causes a hollow member, to which the ribs of the umbrella are attached, to move along a shaft extending through the hollow member. The presently disclosed device accomplishes both the automatic opening, as accomplished by the previous art, (but by a means different from that of the prior art) and in addition discloses a means by which the automatic closing of the umbrella can be accomplished (by a means not disclosed in the prior art).

DESCRIPTION OF THE PREFERRED EMBODIMENT

Figure 1:
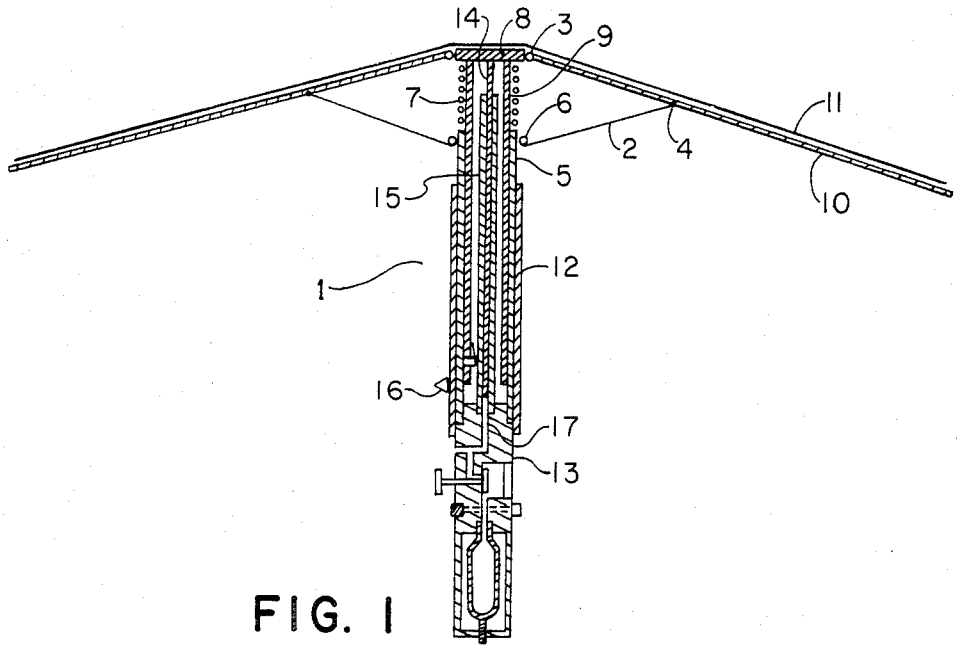
FIG. 1 contains a sectional view of the umbrella mechanism 1 wherein the umbrella is in an opened position.

In FIG. 1 can be seen umbrella ribs 10 held in an open position by umbrella struts 2 wherein umbrella ribs 10 rotate about pivot point 3, while strut 2 and rib 10 are attached one to the other at the second pivot point 4. Ribs 10 are covered by and attached to water repellent fabric 11. In addition strut 2 is attached to outermost cylinder 5 at pivot point 6. Cylinder spring 7 is attached at one of its ends to outermost cylinder 5 and at its opposite end said cylinder spring 7 is attached to cylinder cap 8. Cylinder cap 8 is itself attached to inner cylinder 9 which extends through the center of spring 7, and thence into outer cylinder 5 such that inner cylinder 9 is connected with outer cylinder 5.

Inner cylinder 9 is free to slide up and down within outer cylinder 5. Cylinder 5 is attached at its lower end to the handle 13. Tube 15 is concentrically located within inner cylinder 9 and attached at one end to handle 13. Shaft 14 fits snugly within tube 15 and is attached at one of its ends to cylinder cap 8. Outer sleeve 12 fits snugly around the outside perimeter of outer cylinder 5 and is free to move up and down in relation to outer cylinder 5 with the application of force to thumb piece 16. Axial passage 17, which is oriented along the major axis of handle 13, connects the hollow interior of tube 15 with radial passage 18. Radial passage 18, as shown in FIG. 1, connects axial passage 17 to the exterior of handle 13. Secondary passage 27 which is also located axially intersects radial passage 18 at a right angle, as shown in FIG. 1, such that secondary passage 27 provides a flow path for gases between radial passage 18 and chamber 26.

Figure 2:
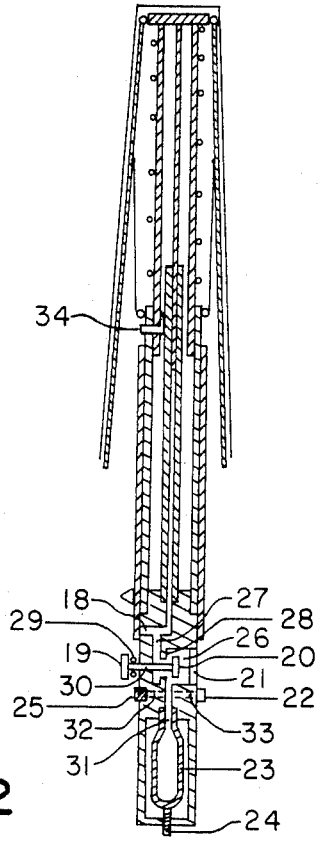
FIG. 2 contains a sectional view of the umbrella mechanism wherein the umbrella mechanism 1 is in a closed position.
Figure 1A:
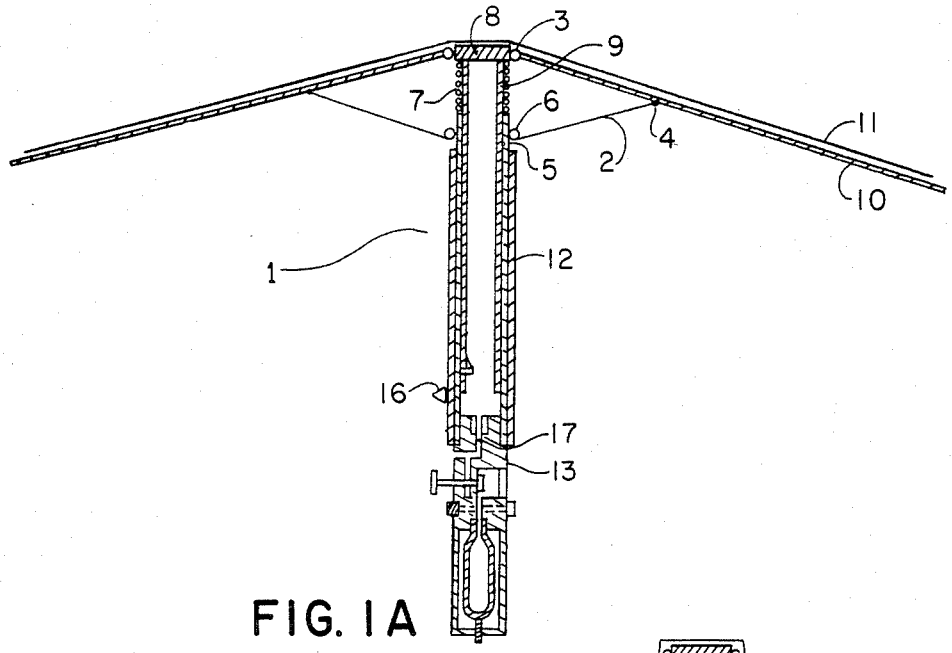
FIG. 1A is a sectional view of an alternate embodiment without shaft 14 and tube 15.
Figure 2A:
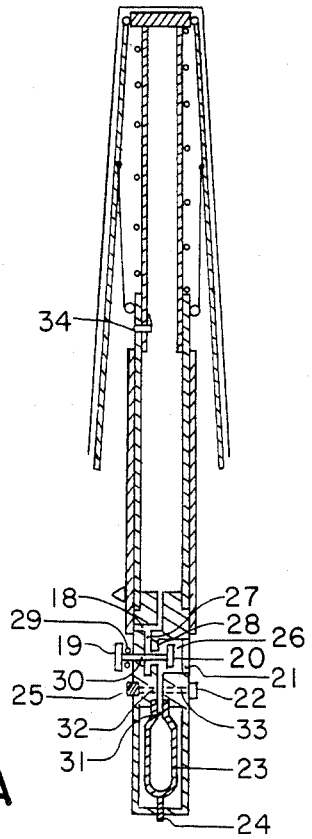
FIG. 2A is a sectional view wherein the alternate umbrella mechanism of 1A is in a closed position.

FIG. 2 shows how upon the depression of button 19 which compresses valve spring 29 the depression of button 19 through the action of valve shaft 30, to which button 19 is connected, causes valve plug 20 to move away from valve seat 28 and thereby allows a passage of pressurized gases contained in chamber 26 into secondary passage 27. Chamber 26 is sealed from the exterior of handle 13 by chamber plug 21 which may be removed to allow disassembly of valve plug 20 from valve shaft 30. Ampule passage 31 connects chamber 26 with ampule 23 wherein said ampule 23 contains gases such as air, nitrogen or carbon dioxide under pressure commonly between 20 and 100 pounds per square inch. Set screw 24 holds ampule 23 firmly against the opening of ampule passage 31 as shown in FIG. 1, to avoid the escape of gases. Needle valve 25 is similar in configuration to valves commonly used in automobile tires and tubes. Needle valve 25 is used to replenish the supply of gas in ampule 23 by means of needle valve passage 32 which intersects ampule passage 31. Pressure relief valve 22 which is connected to ampule passage 31 by pressure relief passage 33 may consist of any one of many designs known in the art capable of avoiding the creation of excess pressure within ampule 23 and chamber 26 during the replenishment of gas within ampule 23 through the use of needle valve 25.

FIG. 2 also shows how upon sliding sleeve 12 on outer cylinder 5 into a position such that it prevents the passage of gas through radial passage 18 to the exterior of handle 13 followed by the subsequent depression of button 19 pressurized gases flow through ampule 23 through ampule passage 31, chamber 26, secondary passage 27, radial passage 18, axial passage 17, and then into the interior of tube 15. The aforesaid gases force shaft 14 and consequently cylinder cap 8 and inner cylinder 9 upward. This upward movement of cylinder cap 8 causes ribs 10 to assume a position (commonly termed the closed position) substantially parallel to and adjacent to sleeve 12 by rotation of strut 2 around pivot point 4 and 6 simultaneous with the rotation of ribs 10 around pivot points 3 and 4 as depicted in FIG. 2. In this position as shown in FIG. 2 catch 34 attached to innder cylinder 9 engages an opening 35 in outer cylinder 5 and holds the umbrella device in the so-called closed position. Thus the closing of the umbrella device is accomplished merely by the depression of button 19.

Figure 3:
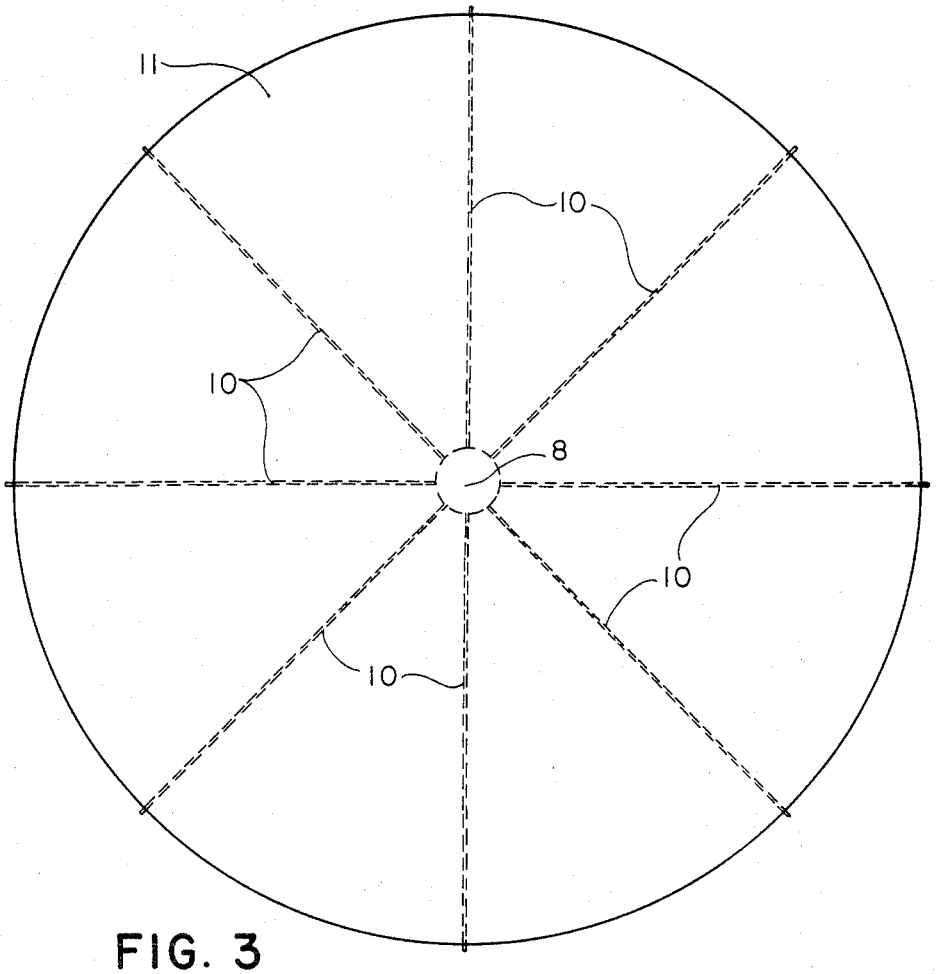
FIG. 3 contains an overhead view of the umbrella mechanism while in the open position depicted in cross section by FIG. 1.
Figure 4:
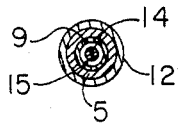
FIG. 4 contains a sectional view taken along lines A—A of FIG. 1.

The opening of the umbrella device is accomplished merely by applying upward pressure on thumb piece 16 which causes sleeve 12 to slide upward on outer cylinder 5 and thereby first opens radial passage 18 to the atmosphere (i.e. to the exterior of handle 13) and then with the continuing upward movement causes the release of catch 34 whereby the retracting action of cylinder spring 7 causes cylinder cap 8 along with shaft 14 in inner cylinder 9 to advance toward the uppermost end of outer cylinder 5 and ultimately assume the relative position shown in FIG. 1. During this opening of the umbrella device button 19 is ideally not depressed thereby conserving the supply of compressed gases contained in ampule 23 and chamber 26. This opened position depicted in cross section by FIG. 1 is further illustrated by the overhead view of the umbrella device shown in FIG. 3. FIG. 4, which is a cross section along lines A—A of FIG. 1, shows the concentric nature of sleeve 12, outermost cylinder 5, inner cylinder 9, tube 15 and shaft 14.

One variation in the structure of the umbrella device shown in FIGS. 1 through 4 eliminates inner cylinder 9 and outer cylinder 5 and simply requires that sleeve 12 fit snugly around tube 15. In this variation cylinder spring 7 is attached to the uppermost end of tube 15 as is pivot point 6 and thereby strut 2. Similarly catch 34 is located on shaft 14 and engages an opening in tube 15 in the closed position shown in FIG. 2 in a manner similar to that employed in the original embodiment of the present umbrella device which does contain inner cylinder 9 and outer cylinder 5. Be it known that this aforementioned variation of the original embodiment, depending on the choice of materials for shaft 14 and tube 15, can exhibit less strength than the original embodiment which is depicted in FIGS. 1 through 4. That is, the presence of inner cylinder 9 and outer cylinder 5 provides a means of increased strength through increased diameter without at the same time requiring larger amounts of gases due to an increase in volume associated with expanding the diameter of tube 15 and shaft 14. Similarly it can be seen that the umbrella device depicted in FIGS. 1 through 4 would also function with the elimination of shaft 14 and tube 15 but so configured the device modified by the exclusion of shaft 14 and tube 15 would require the release of much larger amounts of gas from ampule 23 in order to effect the closing of the umbrella device than the amount of gas required by the umbrella device as shown in FIGS. 1 through 4.

While I have thus described preferred embodiment of the present invention many variations will be apparent to those skills in the art and it must be understood that the foregoing description is intended to be illustrative only and not limitative of the present invention. All such variations and modifications as are in accord with the principles described are meant to fall within the scope of the appended claims.

What is claimed is:

1. An umbrella having a canopy and a frame of interconnected ribs and a means for the automatic opening and closing of the aforesaid ribs and canopy comprising:

a hollow outer cylinder;

a hollow inner cylinder located concentrically within the aforesaid outer cylinder wherein the inner cylinder slidably moves within the aforesaid hollow outer cylinder;

a sleeve which slidably moves on the exterior of the aforesaid hollow outer cylinder;

a hollow inner tube located concentrically within the aforesaid hollow inner cylinder;

a handle attached to the aforesaid hollow outer cylinder and hollow inner tube wherein said handle contains an ampule of compressed gas and said ampule is connected by passageways to the aforesaid hollow inner tube;

an extension spring attached at one end to the aforesaid inner cylinder and at its alternate end attached to the aforesaid outer cylinder;

a latching mechanism preventing the movement of the inner cylinder with respect to the outer cylinder wherein said mechanism is released by the movement of the aforesaid sleeve;

a shaft which fits snugly within the aforesaid inner tube;

a valve disposed within said handle which either stops or allows flow of gas from the aforesaid ampule through passageways to the aforesaid inner tube;

a vent port communicating with said passageways which permits communication of said passageways with the atmosphere upon the movement of the aforesaid sleeve;

movement in one direction of said sleeve simultaneously releasing said latching mechanism and opening said vent port to atmosphere, movement of said sleeve in a direction reverse of the aforesaid direction allowing said latching mechansim to engage while sealing said vent so that fluid pressure from said ampule may impinge against said shaft.

2. An umbrella having a canopy and a frame of interconnected ribs and a means for the automatic opening and closing of the aforesaid ribs and canopy comprising:

a hollow outer cylinder;

a hollow inner cylinder located concentrically within the aforesaid outer cylinder wherein the inner cylinder slidably moves within the aforesaid hollow outer cylinder;

a sleeve which slidably moves on the exterior of the aforesaid hollow outer cylinder;

a handle attached to the aforesaid hollow outer cylinder wherein said handle contains an ampule of compressed gas and said ampule is connected by passageways to the interior of said hollow outer cylinder;

an extension spring attached at one end to the aforesaid inner cylinder and at its alternate end attached to the aforesaid outer cylinder;

a latching mechanism preventing the movement of the inner cylinder with respect to the outer cylinder wherein said mechanism is released by the movement of the aforesaid sleeve;

a valve disposed within said handle which either stops or allows flow of gas from the aforesaid ampule through passageways to the interior of the aforesaid hollow outer cylinder;

a vent port communicating with said passageways which permits communication of said passageways with the atmosphere upon movement of the aforesaid sleeve;

movement in one direction of said sleeve simultaneously releasing said latching mechanism and opening said vent port to atmosphere, movement of said sleeve in a direction reverse of the aforesaid direction allowing said latching mechanism to engage while sealing said vent so that fluid pressure from said ampule may impinge against said hollow inner cylinder.

* * * * *